US010533785B2

(12) United States Patent
Ma

(10) Patent No.: US 10,533,785 B2
(45) Date of Patent: Jan. 14, 2020

(54) THERMOELECTRIC PURGE UNIT

(71) Applicant: Carrier Corporation, Jupiter, FL (US)

(72) Inventor: Zidu Ma, Ellington, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 221 days.

(21) Appl. No.: 15/522,014

(22) PCT Filed: Oct. 16, 2015

(86) PCT No.: PCT/US2015/055946
§ 371 (c)(1),
(2) Date: Apr. 26, 2017

(87) PCT Pub. No.: WO2016/069294
PCT Pub. Date: May 6, 2016

(65) Prior Publication Data

US 2018/0283747 A1 Oct. 4, 2018

Related U.S. Application Data

(60) Provisional application No. 62/069,949, filed on Oct. 29, 2014.

(51) Int. Cl.
*F25B 43/04* (2006.01)
*F25B 21/02* (2006.01)

(52) U.S. Cl.
CPC ..... *F25B 43/043* (2013.01); *F25B 21/02* (2013.01); *F25B 2321/0252* (2013.01)

(58) Field of Classification Search
CPC ..... F25B 43/043; F25B 21/02; F25B 2321/0252; F25B 2321/02
See application file for complete search history.

(56) References Cited

U.S. PATENT DOCUMENTS 3,008,300 A * 11/1961 Ryan ..... F24H 4/04 136/204
3,054,840 A * 9/1962 Alsing ..... H01L 35/32 136/204
3,287,923 A * 11/1966 Elfving ..... F24F 5/0042 136/203

(Continued)

FOREIGN PATENT DOCUMENTS

CN 1114037 A 12/1995
CN 1185454 C 1/2005

(Continued)

OTHER PUBLICATIONS

International Search Report and Written Opinion dated May 10, 2016 for PCT/US2015/055946.

(Continued)

*Primary Examiner* — Kun Kai Ma
(74) *Attorney, Agent, or Firm* — Bachman & LaPointe, P.C.

(57) ABSTRACT

A purge unit (100; 600) comprises a vessel (234; 606) having an inlet (152; 608), a return port (154; 610), a first path between the inlet and the return port, a purge port (156; 612), and a second path between the inlet and the purge port. One or more thermoelectric units (220) are positioned to be in thermal communication with at least the first path.

20 Claims, 5 Drawing Sheets

(56) References Cited

U.S. PATENT DOCUMENTS 3,721,104 A * 3/1973 Adler ..... B63J 2/12 62/240
3,734,293 A * 5/1973 Biskis ..... B01D 53/0438 210/185
3,737,762 A * 6/1973 Fletcher ..... H01L 35/00 324/451
4,290,273 A * 9/1981 Meckler ..... F25B 15/02 62/148
4,881,958 A * 11/1989 Eckardt ..... G21C 19/303 96/127
4,993,230 A * 2/1991 Hingst ..... F25B 9/02 62/3.2
5,092,129 A * 3/1992 Bayes ..... B64G 6/00 62/259.3
5,522,216 A 6/1996 Park et al.
5,932,885 A * 8/1999 DeBellis ..... F23C 3/002 136/253
6,128,916 A 10/2000 Callahan et al.
6,236,810 B1 * 5/2001 Kadotani ..... F25B 21/02 392/483
6,295,819 B1 10/2001 Mathiprakasam et al.
6,370,884 B1 * 4/2002 Kelada ..... B67D 1/0869 62/3.3
7,479,219 B2 * 1/2009 Rassinger ..... B01D 29/114 210/130
8,656,710 B2 * 2/2014 Bell ..... F01N 3/043 165/51
9,145,811 B2 * 9/2015 An ..... F01N 5/025
2002/0162339 A1 11/2002 Harrison et al.
2005/0172993 A1 * 8/2005 Shimoji ..... H01L 35/30 136/208
2006/0048519 A1 * 3/2006 Childress ..... B60H 1/00264 62/3.3
2006/0137361 A1 * 6/2006 Ghoshal ..... F25B 21/02 62/3.7
2006/0248902 A1 * 11/2006 Hunnell ..... F25B 21/02 62/3.6
2008/0028769 A1 * 2/2008 Goenka ..... B60H 1/00328 62/3.7
2008/0184710 A1 * 8/2008 DeVilbiss ..... F25B 21/02 62/3.2
2009/0026813 A1 * 1/2009 Lofy ..... B60N 2/5635 297/180.15
2011/0016886 A1 1/2011 Ghoshal et al.
2011/0083459 A1 4/2011 Salyer
2012/0118344 A1 * 5/2012 Schluck ..... F01N 5/025 136/201
2014/0075963 A1 3/2014 Boarman
2015/0243866 A1 * 8/2015 Iriyama ..... F01N 5/025 60/320
2018/0031285 A1 * 2/2018 Thomas ..... F25D 17/06

FOREIGN PATENT DOCUMENTS

DE 4215993 A1 2/1993
DE 102010061144 A1 6/2012
EP 0389407 A1 9/1990
FR 2760977 A1 9/1998
JP 0418902 A 1/1992
JP 2008095331 A 4/2008
WO 2013/003886 A1 1/2013
WO 2014/092850 A1 6/2014
WO 2014/129886 A1 8/2014
WO 2015/030915 A1 3/2015

OTHER PUBLICATIONS

Chinese Office Action dated May 7, 2019 for Chinese Patent Application No. 201580059250.5.

* cited by examiner

THERMOELECTRIC PURGE UNIT

CROSS-REFERENCE TO RELATED APPLICATION

Benefit is claimed of U.S. Patent Application 62/069,949, filed Oct. 29, 2014, and entitled "Thermoelectric Purge Unit", the disclosure of which is incorporated by reference herein in its entirety as if set forth at length.

BACKGROUND

The disclosure relates to vapor compression systems. More particularly, the disclosure relates to purge units for removing contaminants from vapor compression systems.

Many vapor compression systems using low vapor pressure refrigerants include purge units for removing noncondensable contaminants from the system. A flow is diverted from the main refrigerant flowpath and passed into a purge tank where it is cooled to condense refrigerant while leaving noncondensable contaminants in vapor form. The vapor may be vented or pumped out of the vessel (e.g., to atmosphere). The purge unit may operate intermittently.

The condensing heat may be removed by a secondary vapor compression system. The secondary vapor compression system may have its own recirculating refrigerant flowpath proceeding downstream from a compressor to a heat rejection heat exchanger, an expansion device, a heat absorption heat exchanger providing the cooling for the purge tank, and then returning to the compressor.

One particular vapor compression system is used as a chiller to produce chilled water. An exemplary chiller uses a hermetic centrifugal compressor. The exemplary unit comprises a standalone combination of the compressor, a heat rejection heat exchanger, an expansion device, an evaporator unit, and various additional components. Exemplary compressors are electric motor-driven hermetic or semi-hermetic compressors.

WO2014092850A1 discloses chiller systems using low pressure refrigerant. WO2014092850A1 defines "low pressure refrigerant" refrigerant as having a liquid phase saturation pressure below about 45 psi (310.3 kPa) at 104° F. (40° C.) and gives an example of low pressure refrigerant as R245fa. It also references use of "medium pressure refrigerant" which it defines as having a liquid phase saturation pressure between 45 psia (310.3 kPa) and 170 psia (1172 kPa) at 104° F. (40° C.). A further recent low pressure refrigerant is HFO R1233zd(e).

Also, international patent application PCT/US14/43834, filed Jun. 24, 2014, discloses use of phase change material in association with an evaporator of a refrigeration system. Exemplary phase change materials include paraffin waxes, fatty acids from natural oils, and inorganic salt solutions. The exemplary phase change material has a melting temperature (from solid to liquid) at which it absorbs heat while maintaining a substantially constant temperature. In other words, as the phase change material is heated up from a temperature below the melting temperature to the melting temperature, the temperature of the phase change material rises accordingly. However, when the phase change material reaches its melting temperature, the temperature of the phase change material remains substantially the same as it absorbs heat, before all the phase change material becomes liquid.

SUMMARY

One aspect of the disclosure involves a purge unit comprising a vessel having an inlet, a return port, a first path between the inlet and the return port, a purge port, and a second path between the inlet and the purge port. One or more thermoelectric units are positioned to be in thermal communication with at least the first path.

In additional or alternative embodiments of any of the foregoing embodiments, the purge unit further comprises a power supply coupled to the one or more thermoelectric units to, in at least a first mode, cause the one or more thermoelectric units to absorb heat from refrigerant along the first path.

In additional or alternative embodiments of any of the foregoing embodiments, the purge unit further comprises one or more additional thermoelectric units positioned to transfer the heat absorbed by the one or more thermoelectric cooling units.

In additional or alternative embodiments of any of the foregoing embodiments, the one or more additional thermoelectric units are positioned to transfer the heat absorbed by the one or more thermoelectric cooling units to an environment.

In additional or alternative embodiments of any of the foregoing embodiments, the purge unit further comprises: a heat exchange fluid flowpath having a first leg in thermal exchange relation with the one or more thermoelectric units and one or more additional thermoelectric units; and a pump along the heat exchange fluid flowpath.

In additional or alternative embodiments of any of the foregoing embodiments, the one or more additional thermoelectric units are positioned to exchange heat between the heat exchange fluid flowpath and ambient air.

In additional or alternative embodiments of any of the foregoing embodiments, a heat exchange fluid along the heat exchange fluid flowpath comprises at least 50% by weight one or more of water and glycol.

In additional or alternative embodiments of any of the foregoing embodiments, a phase change material is positioned to receive heat absorbed by the one or more thermoelectric units from the first path.

In additional or alternative embodiments of any of the foregoing embodiments, the vessel is an inner vessel, the purge unit comprises an outer vessel containing the inner vessel, and the phase change material is in a space between the outer vessel and the inner vessel.

In additional or alternative embodiments of any of the foregoing embodiments, the one or more thermoelectric units are mounted to the inner vessel, the one or more additional thermoelectric units are mounted to the outer vessel, and one or more finned heat sinks of the one or more thermoelectric units and one or more finned heat sinks of the one or more additional thermoelectric units are immersed in the phase change material.

In additional or alternative embodiments of any of the foregoing embodiments, the one or more finned heat sinks of the one or more thermoelectric units and the one or more finned heat sinks of the one or more additional thermoelectric units have interleaved fins.

In additional or alternative embodiments of any of the foregoing embodiments, the phase change material comprises material selected from the group consisting of paraffin waxes, fatty acids from natural oils, and inorganic salt solutions.

In additional or alternative embodiments of any of the foregoing embodiments, the phase change material has a melting temperature of −20° C. to 15° C.

Another aspect of the disclosure involves a vapor compression system comprising the purge unit of any of the foregoing embodiments and further comprising: a compressor having a suction port and a discharge port; a first heat exchanger coupled to the discharge port to receive refrigerant driven in a downstream direction along a refrigerant flowpath in a first operational condition; an expansion device downstream of the first heat exchanger along the refrigerant flowpath in the first operational condition; a second heat exchanger downstream of the expansion device and coupled to the suction port to return refrigerant in the first operational condition; and said purge unit wherein: the inlet is coupled to the refrigerant flowpath to receive refrigerant; and the return port is coupled to the refrigerant flowpath to return refrigerant.

In additional or alternative embodiments of any of the foregoing embodiments, the purge port is vented to atmosphere.

In additional or alternative embodiments of any of the foregoing embodiments, a refrigerant charge comprises at least 50% by weight an HFO having a liquid phase saturation pressure below 310 kPa at 40° C.

In additional or alternative embodiments of any of the foregoing embodiments, the system is a chiller.

In additional or alternative embodiments of any of the foregoing embodiments, a controller is configured to operate the purge unit to, in a first mode, apply a voltage to the one or more thermoelectric units to cool the received refrigerant to condense the refrigerant.

Another aspect of the disclosure involves a method for operating the system of the foregoing embodiments, the method comprising: operating the purge unit to, in a first mode, apply a voltage to the one or more thermoelectric units to cool the received refrigerant to condense the refrigerant.

Another aspect of the disclosure involves a method for operating a refrigerant purge unit. The method comprises: receiving a flow of refrigerant and contaminant from a flowpath in a vapor compression system; applying a DC voltage to a thermoelectric unit in a polarity to cool the received flow to condense the refrigerant; and returning condensed refrigerant to the flowpath.

In additional or alternative embodiments of any of the foregoing embodiments, the method further comprises venting a flow of the contaminant to atmosphere.

In additional or alternative embodiments of any of the foregoing embodiments, the venting comprises applying a DC voltage to the thermoelectric unit in a polarity to heat the contaminant.

In additional or alternative embodiments of any of the foregoing embodiments, the applying the DC voltage to the thermoelectric unit in the polarity to heat the contaminant also cools a phase change material and/or cools a heat transfer fluid.

In additional or alternative embodiments of any of the foregoing embodiments, the venting further comprises applying a DC voltage to a second thermoelectric unit in a polarity to heat the phase change material.

In additional or alternative embodiments of any of the foregoing embodiments, the applying of the voltage to the thermoelectric unit to cool the received flow also heats a phase change material.

In additional or alternative embodiments of any of the foregoing embodiments, the method further comprises applying a DC voltage to a second thermoelectric unit in a polarity to remove heat from the phase change material.

In additional or alternative embodiments of any of the foregoing embodiments, the applying of the voltage to the thermoelectric unit to cool the received flow also heats a heat transfer fluid and the heat transfer fluid is pumped along a recirculating flowpath through one or more of: a thermal storage device comprising phase change material; and a second thermoelectric unit to which voltage is applied to cool the heat transfer fluid.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

The performance of the state of art purge designs suffers when lower pressure refrigerants are used (which is the case for low global warming potential (GWP) refrigerants). R1233zd(E), for example, has a saturated pressure of around 26.56 psia (183 kPa) at 95° F. (35° C.). In order to achieve a separation ratio of above 200 (a high tier performance as an example), the vapor pressure for the R1233zd(E) refrigerant would be as low as 0.133 psia (26.56 divided by 200) (0.92 kPa) which corresponds to a saturation temperature of roughly −84° F. (−64.4° C.). As a rough estimate, this means that if a mixture of air and R1233zd(E) in a tank held at −84° F. (−64.4° C.), the gas phase has greater than 99.5% air and less than 0.5% of R1233zd(E) and the liquid phase is pure R1233zd(E). To achieve the level of separation (i.e. vapor pressure differences and temperature lift), the state of the art designs require high cost systems.

Figure 1:
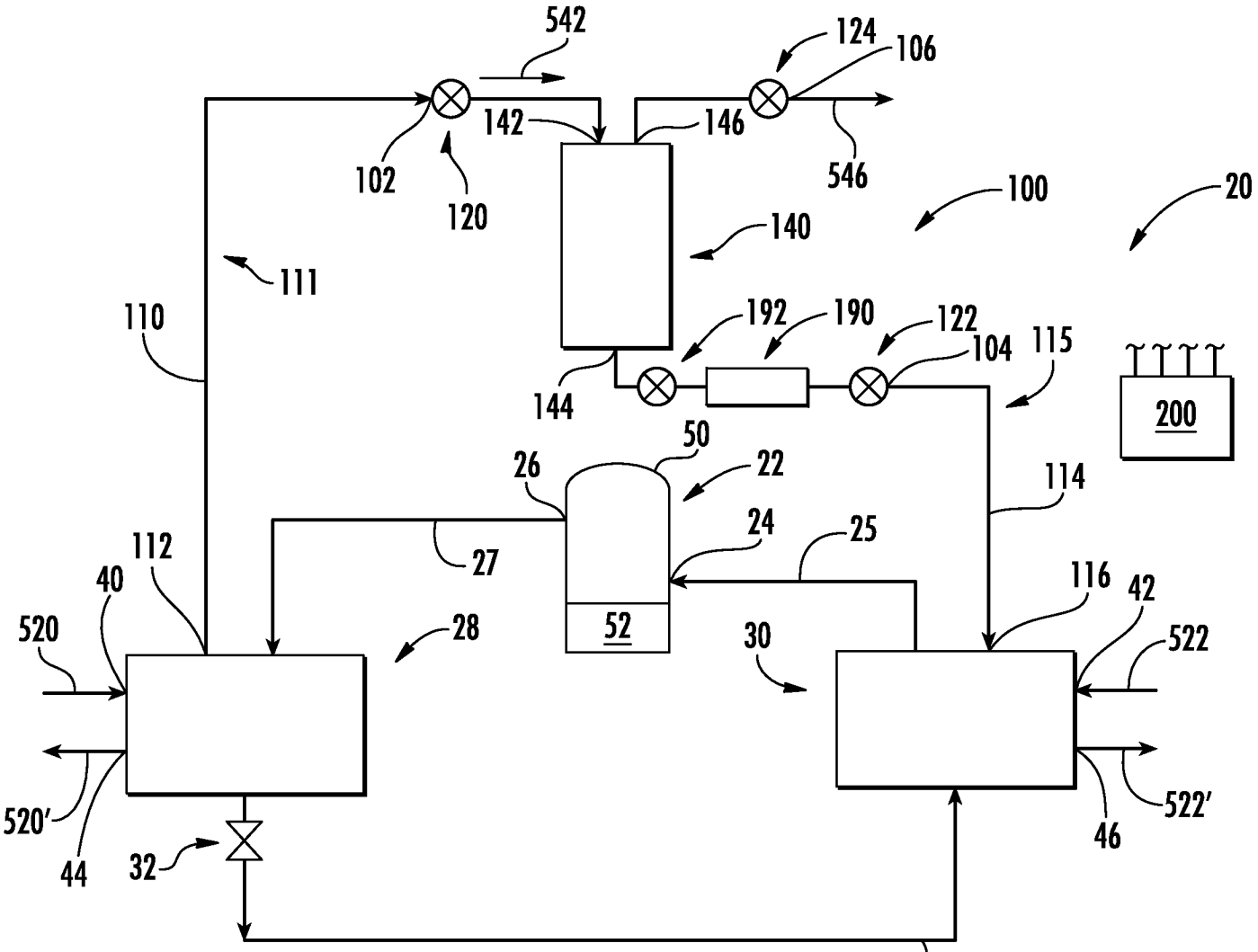
FIG. 1 is a schematic view of a chiller system.

FIG. 1 shows a vapor compression system 20. The exemplary vapor compression system 20 is a chiller system. The system 20 includes a compressor 22 having a suction port (inlet) 24 fed by a suction line 25 and a discharge port (outlet) 26 feeding a discharge line 27. The system further includes a first heat exchanger 28 having a refrigerant inlet connected to the discharge line. In a normal operating mode, the first heat exchanger 28 is a heat rejection heat exchanger (e.g., a condenser). In an exemplary system based upon an existing chiller, the heat exchanger 28 is a refrigerant-water heat exchanger in a condenser unit where the refrigerant is cooled and condensed by an external water flow 520 (inlet), 520' (outlet).

The system further includes a second heat exchanger 30 (in the normal mode a heat absorption heat exchanger or evaporator) having a refrigerant outlet connected to the suction line. In the exemplary chiller system, the heat absorption exchanger 30 is a refrigerant-water heat exchanger for chilling a chilled water flow 522 (inlet), 522' (outlet). An expansion device 32 is downstream of a refrigerant outlet of the heat rejection heat exchanger 28 and upstream of a refrigerant inlet of the heat absorption heat exchanger 30 along the normal mode main refrigerant flowpath 34 (the flowpath being partially surrounded by associated lines/piping, etc. and including the suction line 25, discharge line 26, and intermediate line 35). The exemplary refrigerant-water heat exchangers 28 and 30 comprise tube bundles (not shown) carrying water flow and in heat exchange relation with refrigerant passing around the bundles within the shells or the tubes of the heat exchangers. The heat exchangers have water inlets 40, 42 and outlets 44, 46.

An exemplary compressor is a centrifugal compressor having a housing assembly (housing) 50. The housing assembly contains an electric motor 52 and one or more working elements (not shown; e.g., impeller(s) for a centrifugal compressor, scroll(s) for a scroll compressor, rotors for a screw compressor, or piston(s) for a reciprocating compressor) drivable by the electric motor in the first mode to draw fluid (refrigerant) in through the suction port, compress the fluid, and discharge the fluid from the discharge port.

The exemplary centrifugal working element(s) comprise a rotating impeller directly driven by the motor about an axis. Alternative centrifugal compressors may have a transmission coupling the motor to the impeller(s). Alternative drive systems include compressors having a drive shaft passing through a shaft seal to engage external drive means (e.g., electric or other motor).

FIG. 1 further shows a purge unit 100 for removing contaminant gases from the refrigerant. The exemplary purge unit comprises an inlet (inlet port) 102 for receiving refrigerant from the remainder of the system (e.g., diverted from the main/primary flowpath 34) and a first outlet (outlet port) 104 for returning refrigerant to the remainder of the system (e.g., to the evaporator). For purposes of reference, the inlet port 102 is arbitrarily identified as the inlet port of an inlet valve 120 and the first outlet 104 (a liquid outlet or return outlet or port as is discussed below) is identified as the outlet port of an outlet valve 122. A second outlet 106 may be a purge or vent outlet or port for discharging a flow 546 of contaminant gases. The second outlet 106 is arbitrarily identified as the outlet port of a second outlet valve 124.

Other locations may be alternatively identified as the inlet or outlets. In the exemplary embodiment, the inlet 102 receives the refrigerant from the condenser along a line 110 extending along a flowpath 111 from a port 112. The purge unit returns the refrigerant from the outlet 104 along a line 114 (e.g., along a flowpath 115 to a port 116 on the evaporator). As in a conventional purge unit, the refrigerant is returned from the outlet 104 directly to the main flowpath. As is discussed further below, the flowpath 111 branches off the main flowpath 34 and the flowpath 115 branches off the flowpath 111 so that a bypass flowpath includes the flowpaths 111 and 115.

The purge unit 100 comprises a purge tank 140 having an inlet (inlet port) 142 positioned to receive refrigerant from the outlet of the valve 120; a first outlet (outlet port) 144 (a liquid outlet port as discussed below) positioned to pass liquid along the flowpath 115; and a second outlet (outlet port) 146 (a purge or vent port as discussed below) positioned to pass the flow 546 to the inlet of the valve 124.

The inlet flow 542 contains refrigerant and contaminants. In the purge tank 140 (FIG. 2), the inlet flow is cooled to condense out liquid 160 and leave a headspace 162 thereabove containing gas. The liquid is refrigerant with similarly condensable contaminants. The gas consists essentially (if not entirely) of other contaminants (e.g., air) which are not as easily condensed as the refrigerant.

A discharge (exhaust) flowpath 163 from the port 146 to the outlet 106 may pass along a discharge (exhaust) line 164 and through a pump (not shown) and one or more valves 106. The valves serve to eliminate leaking of refrigerant to atmosphere. As does the flowpath 115, the flowpath 163 branches off from the flowpath 111 which serves as a common trunk.

To condense refrigerant in the purge tank, means for cooling the inlet flow 542 in the purge tank 140 are provided. The exemplary means comprises solid state heat pumps (SSHP) (also known as thermoelectric cooling units or Peltier coolers). More particularly, the exemplary means comprises two stages of such SSHP units. A first stage of SSHP units 220 directly extracts heat from the refrigerant. A second stage of SSHP units 222 may further pass the heat extracted by the first stage to a cooling medium. One exemplary cooling medium is an external airflow 560 (e.g., ambient air of the external environment). An alternative cooling medium may be an external water flow. This water flow may be part of the same flow or a flow from the same source as the flow 520 used to cool the condenser. Depending on configuration, such flows may be either unforced flows or forced flows (via fan or pump depending on the state).

To increase the capacity and/or stabilize purge unit operation, a phase change material (PCM) 230 may be used. For example, the second stage of heat pumps may lack the capacity to extract/lift all the heat extracted by the first stage. Thus, the latent heat of melting of the PCM may be chosen to supplement any cooling available from the second stage during a cycle of the first stage. In the exemplary implementation, a phase change material is used to mitigate temperature at an interstage of the two solid state heat pump stages. An exemplary phase change material has a melting point (at standard or ambient pressure) in a range of −20° C. to 15° C., more particularly, −5° C. to 12° C. or 0° C. to 10° C. or 3° C. to 10° C. Exemplary phase change materials include paraffin waxes, fatty acids from natural oils, and inorganic salt solutions. The particular melting point of the PCM may be selected in view of the ambient temperature to which heat is rejected and the desired cooling temperature in the vessel for condensing refrigerant. In one example, the desired internal temperature of the unit condensing the refrigerant is −45° C. and the ambient temperature is 35° C. for a temperature lift of 80° C. In view of the available capacity of the first stage units, an SSHP melting point of approximately 0° C. or the broader values above may be selected.

Figure 2:
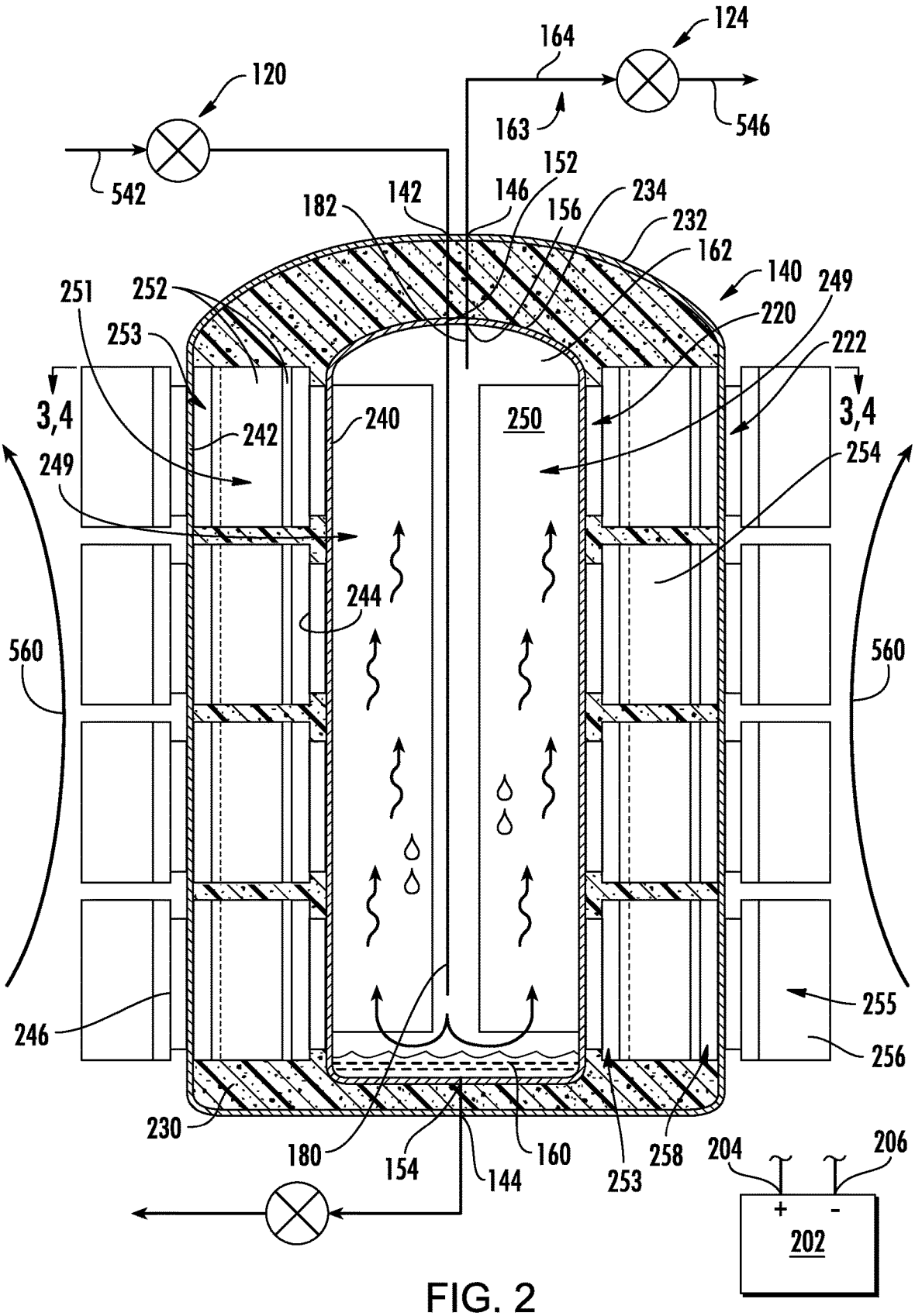
FIG. 2 is a partially schematic central vertical/axial sectional view of a purge unit of the chiller system of FIG. 1.

In the exemplary FIG. 2 configuration, the phase change material 230 is contained in the space between an outer tank or vessel 232 and an inner tank or vessel 234 within the outer tank. Alternatively characterized, these may be regarded as two walls of a dual-wall tank or vessel 140. The ports 142, 144, and 146 communicate with respective corresponding ports 152, 154, 156 of the inner tank (e.g., via having conduit segments passing through the space between the tanks). Thus, the liquid refrigerant accumulation 160 is in a lower portion/base of the inner tank 234 and the headspace 162 is a headspace of the inner tank 234.

Figure 3:
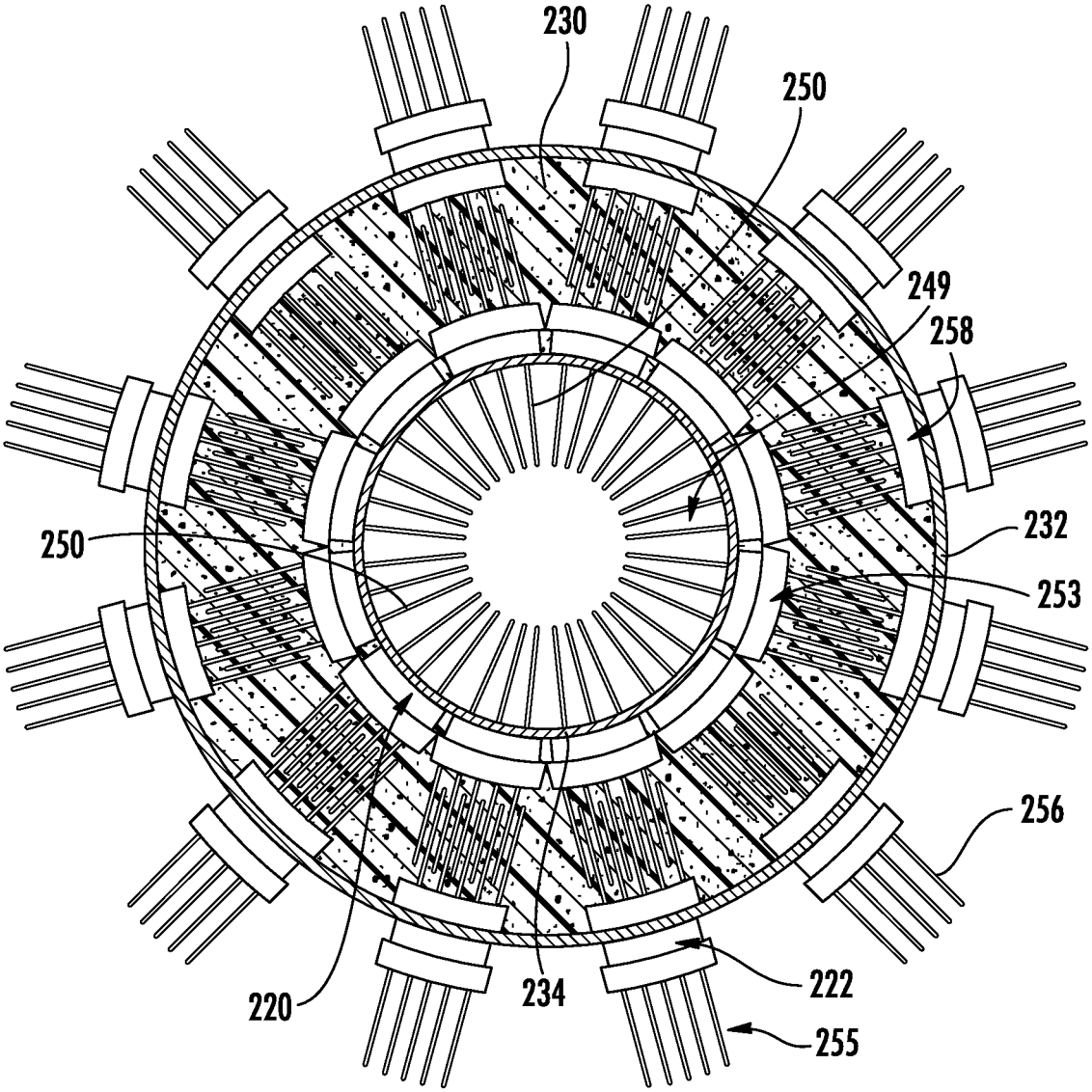
FIG. 3 is a partially schematic transverse sectional view of a vessel of the purge unit of FIG. 2.
Figure 4:
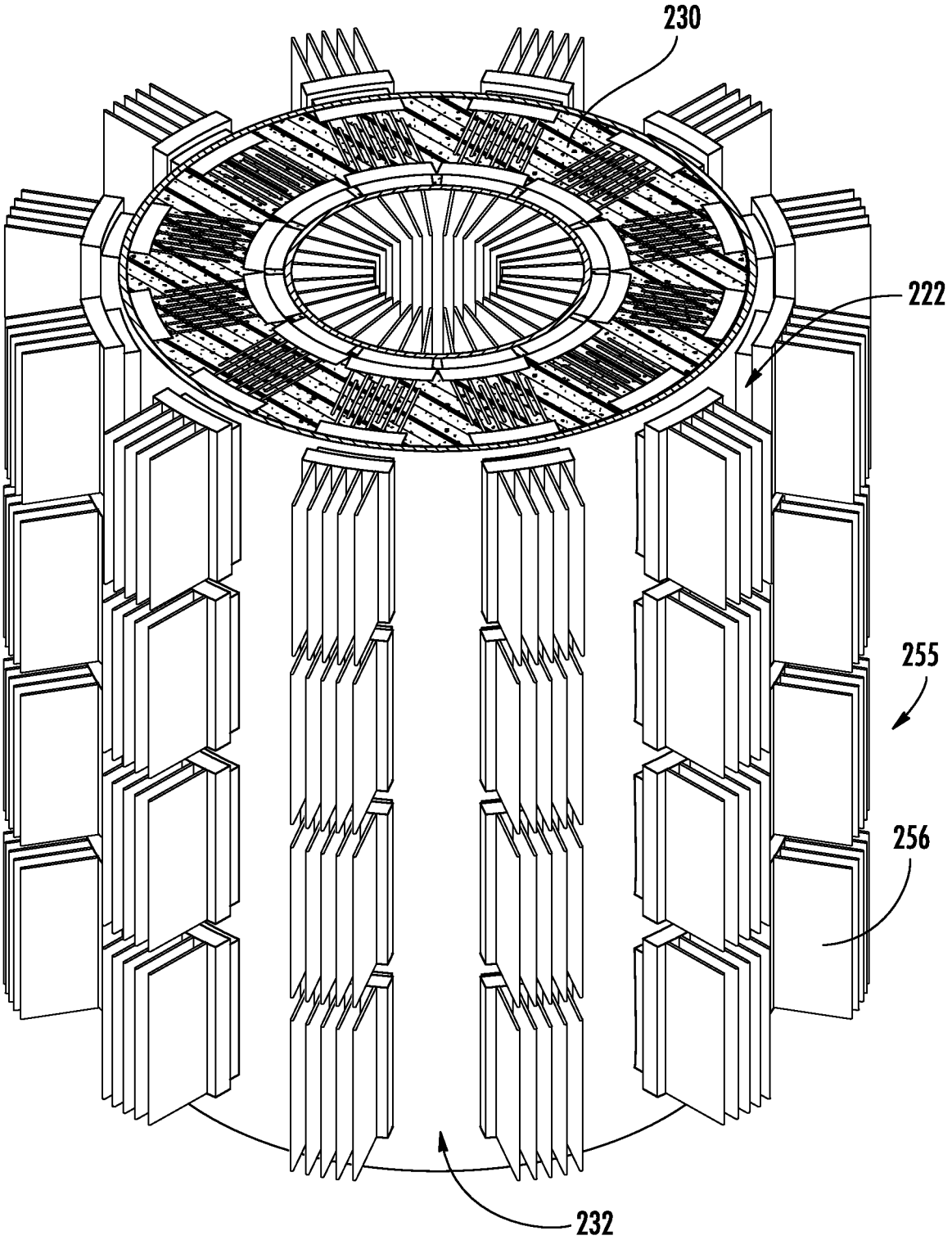
FIG. 4 is a partially schematic view transverse cutaway view of the vessel of the purge unit of FIG. 2.

To facilitate heat transfer, the heat pumps of the two stages may be provided with heat transfer surfaces (e.g., fin arrays) at both sides of the solid state heat pump unit. In the exemplary implementation of generally cylindrical tanks (e.g., with one or two domed ends) each stage of solid state heat pumps comprises a plurality of heat pumps circumferentially and vertically arrayed. The exemplary illustrated FIG. 2 purge unit shows each stage as comprising four vertically arrayed circumferential rings of heat pumps with FIG. 3 showing each ring including twelve heat pumps. These counts are merely illustrative.

Each of the heat pump units has a first side 240, 242 and a second side 244, 246. In normal operational modes of each stage of the units, the first side 240, 242 is a cold side and the second side 244, 246 is a hot side. Each of the units 220, 222 is electrically connected to an electric power source 202 (FIG. 2). The exemplary power source 202 is a DC power supply having terminals 204 and 206 coupled by wiring (not shown) to the units 220, 222 in known fashion. If independent control is desired, this may be accomplished by switching (not shown) and/or by having multiple power supplies or multiple independently controllable sets of terminals from a given power supply. If certain alternative modes are desired, the heat flow direction may be reversed by reversing polarity to the units of the desired stage.

In the exemplary embodiment, the first sides 240 of the units 220 are in thermal communication with heat transfer fins 250 of a heat sink 249. In the exemplary embodiment, there is a single circumferential array of heat transfer fins 250 secured radially along the inner surface of the sidewall of the inner tank 234. Thus, thermal communication between the first sides 240 and the fins 250 is through the inner tank sidewall. Accordingly, exemplary material for the inner tank is thermally conductive such as an alloy. In the exemplary embodiment, the remaining sets of heat transfer fins are individually associated with the units 220 and 222. Thus, the first side of each heat pump unit 222 is in thermal communication with a heat sink 251 having an array of fins 252; the second side of each heat pump unit 220 is in thermal communication with a heat sink 253 having an array of fins 254; and the second side 246 of each heat pump unit 222 is in thermal communication with a heat sink 255 having an array of fins 256.

In the exemplary illustrated FIG. 2 configuration, an inlet tube 180 passes downward to an outlet near the bottom of the vessel to discharge the refrigerant-contaminant mixture. A purge outlet tube 182 (e.g., a beginning of the flowpath 163) has an inlet in the headspace. As gas passes upward in heat exchange relation with the fins 250 of the heat exchanger 249, it is cooled causing droplets of refrigerant to condense and fall to the refrigerant accumulation 160 or withdrawal/return to the main flowpath 34. For ease of illustration, the tubes 180 and 182 are not shown in the remaining views.

In the exemplary embodiment, the first sides 242 of the heat pump units 222 are mounted to the exterior surface of the sidewall of the outer tank 232 and thermally communicate therethrough to the associated heat sink 253.

Within the space between the vessels, the fins of the heat sinks 251 and 253 are interleaved with each other. In this exemplary example, the fins of each heat sink 251 are interleaved with the fins of exactly one other heat sink 253. The exemplary interleaving leaves sufficient space between the fins to accommodate phase change material 230.

Various other features (whether illustrated or not) may be as are used in conventional purge systems. These may include a variety of sensors, ports, pumps, and the like. For example, FIG. 1 further shows an optional filter/dryer unit 190 in the return line from the port 144 to the flowpath 35. Among likely sensors would be a sensor such as a float switch for determining liquid level in the purge tank/vessel. FIG. 1 also shows an additional valve 192 upstream of the filter/dryer unit 190 to provide further flexibility in isolating system components (e.g., allowing closure of the valves 192 and 122 to isolate the filter/dryer unit for purposes such as replacement).

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The purge unit may be controlled by the controller 200 by methods similar to those already used in existing purge units. A main "on" or running mode may involve operating both stages of SSHP units 220, 222 to respectively extract heat from the refrigerant and, in turn, pass that heat to the environment. More specifically, given the functioning of the PCM, the second stage of units 222 may extract only a portion of the heat initially and then later extract the remainder (e.g., in a recharge mode after the first stage is shut off). A variant "on" mode may operate only the first stage. This may represent an initial condition or a low load condition wherein the phase change material may absorb sufficient heat without use of the second stage. It might also be used where there is insufficient power to desirably operate the second stage. Similarly, the recharge mode could involve running only the second stage units to solidify the phase change material when extraction of heat from the refrigerant in the purge unit is not needed.

Further modes involve operating one or both stages or subgroups of units thereof with reversed polarity relative to the "on" modes. For example, this may be used to put heat into the vessel interior to heat the air or other contaminant to increase pressure and/or aid in its evacuation. For example, reverse polarity of the units 220 may put heat into the gas in the vessel and raise pressure. Simultaneously, this cools the PCM and may help in its resolidification. This may reduce or eliminate the need to use the second stage units 222 for recharging. Thus, a first such variation on a "purge" mode may involve running only the units 220. A second variation that most speedily recharges might involve operating the units 220 with a reversed polarity while operating the units 222 with the normal "on" mode polarity. However, if such mode variations are not sufficient to provide the desired amount of heat to the gas, a third variation might involve running both stages reversed relative to the "on" mode so that the second stage of units 222 puts heat into the PCM for the first stage of units 220 to further transfer to the air. The controller may select amongst these mode variations based upon sensed and/or user-entered conditions.

Accordingly, an exemplary purge cycle may start with the inlet valve 120 closed, the second outlet valve 124 closed and one or both of the valves 122 and 192 closed (to block the liquid outlet and fully isolate the purged unit from the main flowpath 34). When a purge cycle is needed (e.g., determined by similar logic used in current purge systems) the controller 200 may open the inlet valve 120 and initiate the appropriate "on" mode. This initiates cooling of refrigerant-contaminant mixture along portions of paths between the inlet and the purge and return ports (e.g., along an intersection of those paths). The controller 200 may then command closure of the inlet valve 120. There may be a lag or lead of the valve closure and any termination of the "on" mode. However, at some point, after the closure of the valve 120, the controller will open the valves 192 and 122 to pass liquid refrigerant along the flowpath 115 back to the main flowpath 34. When sufficient refrigerant has been returned (e.g., as determined by the controller 200 responsive to level sensors or the like) the valves 122 and 192 may be re-closed by the controller in preparation for operation in the appropriate "purge" mode of the SSHP stages. The heat pump stages may be operated to heat the contaminant in the vessel and raise pressure of the headspace to a purging pressure. The exemplary pressure may be raised to an exemplary value in the range of 15%-20% of the condensing pressure in an exemplary system without a pump. Alternative systems might use a pump along the flowpath 163 to evacuate air. Upon determining sufficient purge pressure, the controller may open the valve 124 to allow the air to purge. Thereafter (e.g., after pressure drops to a threshold value) the valve 124 may be closed. Any recharge may then complete in preparation for the next purge cycle.

As is discussed above, an exemplary water-cooled purge unit may have the flows 560 be forced or unforced water flows. In an exemplary forced flow situation, a further tank (not shown) surrounds the illustrated tanks and passes a water flow from a water inlet to a water outlet. The water flow 560 passes over the heat sinks 255 to absorb heat from the second stage units. Other heat exchanger and heat sink configurations are possible as are other configurations of SSHP units.

Figure 5:
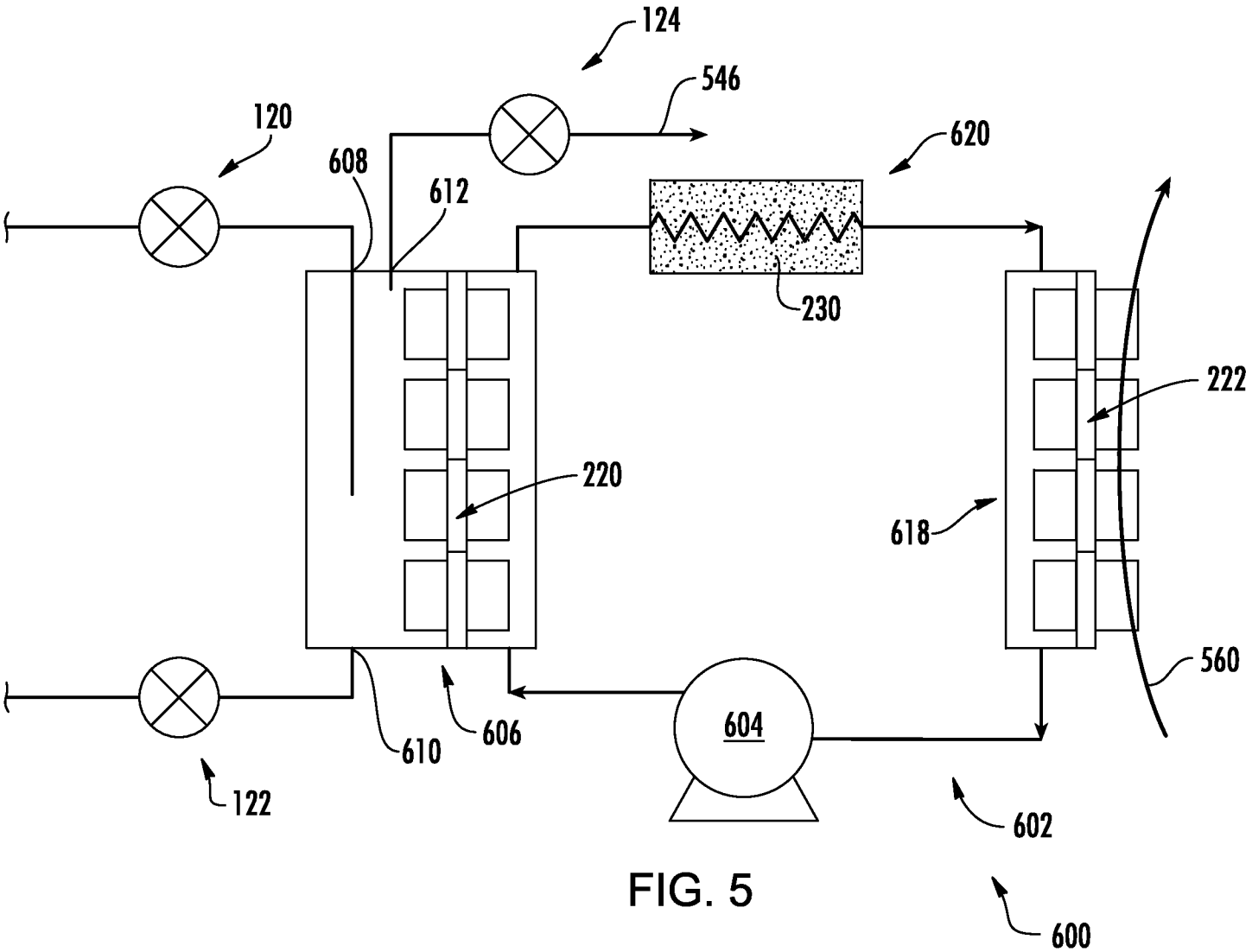
FIG. 5 is a schematic view of an alternate purge unit for the chiller system of FIG. 1.

Among variations are purge systems (e.g., 600, FIG. 5) that further physically separate the SSHP stages (if two or more stages are used) and/or the PCM (if any). For example, the two exemplary stages may be at different locations along a heat transfer fluid loop (flowpath) 602. An exemplary heat transfer fluid loop is a liquid loop and comprises at least 50% by weight of one or more of water and glycol as a heat transfer fluid. A pump 604 may pump the fluid in recirculating fashion along the loop. A purge vessel 606 may be along the loop having an inlet port 608, a return port 610, and a purge port 612. Refrigerant within the vessel may be in heat exchange relation with one side of SSHP unit(s) 220 of the first stage of two stages (or the only stage of a single-stage system). The heat transfer fluid loop may be in heat exchange relation with the other side of said SSHP units of the first stage.

For ease of illustration, the exemplary first stage units 220 are shown arrayed upstream-to-downstream between two side-by-side portions of a vessel or simply flat between two vessels. However, other configurations might involve concentric tanks as in the first embodiment.

At a remote location, heat may be extracted from the heat transfer fluid loop. An exemplary extraction may also be via SSHP units with a second stage of SSHP unit(s) 222 having one side in heat exchange relation with the heat exchange fluid loop and the other side in heat exchange relation (e.g., in heat exchanger vessel 618) with a second flow or body of forced or unforced heat exchange fluid 560 acting as a thermal sink (e.g., ambient air of the environment or cooling water). As noted above for the first stage units 220, the second stage units 222 may be arrayed in any of numerous possible configurations including a flat array between two side-by-side volumes or between spaces associated with two concentric vessels.

In addition to or independently of the presence of the second stage SSHP units, a PCM 230 may be located somewhere along the heat transfer fluid loop. An exemplary PCM may be located in a heat exchanger 620 in communication with the heat transfer fluid loop. This may be integrated with one of the SSHP stages or separate from both. An exemplary separate location is downstream of the first stage. An exemplary pump position is upstream of the first stage.

Further variations may involve using the PCM as the heat transfer fluid in a heat transfer fluid loop. For example, the heat exchanger 620 of FIG. 5 may be replaced by a vessel serving as a buffer for storing some of the PCM. In such a system, it may be desirable to avoid full solidification of the PCM in any location that would interfere with system operation. For example, it may be particularly desirable to avoid full solidification anywhere outside of the purge vessel 606. However, for some purposes, it might also be desirable to avoid full solidification in the purge vessel 606. Accordingly, the control system may monitor temperature (via appropriate sensors not shown) at various locations along the heat transfer fluid loop 602 to avoid such complete solidification. For example, the PCM state would either be pure liquid or a slurry at all locations along the loop 602. If necessary, the thermoelectric units 220 or 222 could be used to add heat to avoid such full solidification. In such a loop 602, the PCM may be one or more of the materials noted above. A mixture of several miscible PCM may have advantages in avoiding full solidification.

The purge system and its use may have one or more of several advantages relative to purge systems using vapor compression cycles. First, the thermoelectric purge system may provide a low cost purge system, particularly for low pressure/low GWP refrigerants. In addition to savings on the cooling hardware, there may be savings related to control. It may be easier to configure/program control hardware for the thermoelectric units to provide desired purge condensing conditions. This may entail simpler control hardware and/or fewer sensors, actuators, and the like. Second, it may provide enhanced adaptability (e.g., the same model of thermoelectric purge system or at least major components thereof may be used with vapor compression systems having different refrigerants or otherwise having different purge condensing requirements such as temperatures and capacities). Such adaptability or adjustability may be achieved by control of voltage to the thermoelectric units, by selection of PCM properties, or by control of other components of the purge unit if present. Third, the thermoelectric purge system may offer compactness or other packaging flexibility.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description. Similarly, the exemplary referenced directions merely establish a frame of reference and do not require any absolute orientation relative to a user. For example, the compressor front may well be at the rear of some larger system in which it is situated.

Where a measure is given in English units followed by a parenthetical containing SI or other units, the parenthetical's units are a conversion and should not imply a degree of precision not found in the English units.

Although embodiments are described above in detail, such description is not intended for limiting the scope of the present disclosure. It will be understood that various modifications may be made without departing from the spirit and scope of the disclosure. For example, when applied to the reengineering of an existing vapor compression system or a vapor compression system in an existing application, details of the existing vapor compression system or application may influence details of any particular implementation. Accordingly, other embodiments are within the scope of the following claims.

What is claimed is:

1. A purge unit comprising:

a vessel having:

an inlet;

a return port, a first path providing fluid communication from the inlet to the return port; and a purge port, a second path providing fluid communication from the inlet to the purge port;

one or more thermoelectric units positioned to be in thermal communication with at least the first path; and one or more additional thermoelectric units positioned to transfer the heat absorbed by the one or more thermoelectric units.

2. The purge unit of claim 1 wherein:

the one or more additional thermoelectric units are positioned to transfer the heat absorbed by the one or more thermoelectric units to an environment.

3. The purge unit of claim 1 further comprising:

a phase change material positioned to receive heat absorbed by the one or more thermoelectric units from the first path.

4. The purge unit of claim 3 wherein:

the phase change material comprises material selected from the group consisting of paraffin waxes, fatty acids from natural oils, and inorganic salt solutions.

5. The purge unit of claim 3 wherein:

the phase change material has a melting temperature of −20° C. to 15° C.

6. The purge unit of claim 1 wherein:

the return port is coupled to the inlet to pass a liquid portion of a flow received through the inlet; and the purge port is positioned to discharge a vapor portion of the flow received through the inlet.

7. A purge unit comprising:

a vessel having:

an inlet;

a return port, a first path between the inlet and the return port; and a purge port, a second path between the inlet and the purge port;

one or more thermoelectric units positioned to be in thermal communication with at least the first path;

one or more additional thermoelectric units positioned to transfer the heat absorbed by the one or more thermoelectric units;

a heat exchange fluid flowpath having a first leg in thermal exchange relation with the one or more thermoelectric units and the one or more additional thermoelectric units; and a pump along the heat exchange fluid flowpath.

8. The purge unit of claim 7 wherein:

the one or more additional thermoelectric units are positioned to exchange heat between the heat exchange fluid flowpath and ambient air.

9. The purge unit of claim 7 wherein:

a heat exchange fluid along the heat exchange fluid flowpath comprises at least 50% by weight one or more of water and glycol.

10. A purge unit comprising:

a vessel having:

an inlet;

a return port, a first path between the inlet and the return port; and a purge port, a second path between the inlet and the purge port;

one or more thermoelectric units positioned to be in thermal communication with at least the first path;

a phase change material positioned to receive heat absorbed by the one or more thermoelectric units from the first path;

one or more additional thermoelectric units positioned to transfer the heat absorbed by the one or more thermoelectric units, wherein:

the vessel is an inner vessel;

the purge unit comprises an outer vessel containing the inner vessel; and the phase change material is in a space between the outer vessel and the inner vessel.

11. The purge unit of claim 10 wherein:

the one or more thermoelectric units are mounted to the inner vessel;

the one or more additional thermoelectric units are mounted to the outer vessel; and one or more finned heat sinks of the one or more thermoelectric units and one or more finned heat sinks of the one or more additional thermoelectric units are immersed in the phase change material.

12. The purge unit of claim 11 wherein:

the one or more finned heat sinks of the one or more thermoelectric units and the one or more finned heat sinks of the one or more additional thermoelectric units have interleaved fins.

13. A vapor compression system comprising:

a compressor having a suction port and a discharge port;

a first heat exchanger coupled to the discharge port to receive refrigerant driven in a downstream direction along a refrigerant flowpath in a first operational condition;

an expansion device downstream of the first heat exchanger along the refrigerant flowpath in the first operational condition;

a second heat exchanger downstream of the expansion device and coupled to the suction port to return refrigerant in the first operational condition; and a purge unit comprising:

a vessel having:

an inlet coupled to the refrigerant flowpath to receive refrigerant;

a return port, a first path between the inlet and the return port, the return port coupled to the refrigerant flowpath to return refrigerant; and a purge port, a second path between the inlet and the purge port;

one or more thermoelectric units positioned to be in thermal communication with at least the first path; and one or more additional thermoelectric units positioned to transfer the heat absorbed by the one or more thermoelectric units.

14. The vapor compression system of claim 13 further comprising:

a controller configured to operate the purge unit to, in a first mode, apply a voltage to the one or more thermoelectric units to cool the received refrigerant to condense the refrigerant.

15. A method for operating the system of claim 13, the method comprising:

operating the purge unit to, in a first mode, apply a voltage to the one or more thermoelectric units to cool the received refrigerant to condense the refrigerant.

16. A method for operating a purge unit, the purge unit comprising:

a vessel having:

an inlet;

a return port, a first path between the inlet and the return port; and a purge port, a second path between the inlet and the purge port;

one or more thermoelectric units positioned to be in thermal communication with at least the first path; and one or more additional thermoelectric units positioned to transfer the heat absorbed by the one or more thermoelectric units, the method comprising:

receiving a flow of refrigerant and contaminant into the inlet of the vessel from a flowpath in a vapor compression system;

applying a DC voltage to the one or more thermoelectric units in a polarity to cool the received flow to condense the refrigerant;

returning condensed refrigerant from the return port of the vessel to the flowpath; and venting a flow of the contaminant to atmosphere, the venting comprising:

applying a DC voltage to the one or more thermoelectric units in a polarity to heat the contaminant, the applying the DC voltage to the one or more thermoelectric units in the polarity to heat the contaminant also cooling a phase change material and/or cooling a heat transfer fluid.

17. The method of claim 16 wherein the venting further comprises:

applying a DC voltage to the one or more additional thermoelectric units in a polarity to heat the phase change material.

18. The method of claim 16 wherein:

the applying of the DC voltage to the one or more thermoelectric units to cool the received flow also heats the phase change material.

19. The method of claim 18 further comprising:

applying a DC voltage to the one or more additional thermoelectric units in a polarity to remove heat from the phase change material.

20. The method of claim 16 wherein:

the applying of the voltage to one or more thermoelectric units to cool the received flow also heats the heat transfer fluid; and the heat transfer fluid is pumped along a recirculating flowpath through one or more of:

a thermal storage device comprising phase change material; and the one or more additional thermoelectric units to which voltage is applied to cool the heat transfer fluid.

* * * * *